US011440211B2

(12) United States Patent
Chen

(10) Patent No.: US 11,440,211 B2
(45) Date of Patent: Sep. 13, 2022

(54) CRAFTING DIES

(71) Applicant: Crafter's Companion Limited, Newton Aycliffe (GB)

(72) Inventor: Yongjia Chen, Yunfu (CN)

(73) Assignee: CRAFTER'S COMPANION LIMITED, Newton Aycliffe (GB)

( * ) Notice: Subject to any disclaimer, the term of this patent is extended or adjusted under 35 U.S.C. 154(b) by 0 days.

(21) Appl. No.: 16/925,488

(22) Filed: Jul. 10, 2020

(65) Prior Publication Data

US 2021/0008749 A1 Jan. 14, 2021

(30) Foreign Application Priority Data

Jul. 11, 2019 (WO) ..... PCT/CN2019/095614

(51) Int. Cl.

| | |
|---|---|
| ***B26F 1/44*** | (2006.01) |
| ***D06C 23/04*** | (2006.01) |
| ***D06H 7/00*** | (2006.01) |
| *B26F 1/42* | (2006.01) |

(52) U.S. Cl.

CPC ..... *B26F 1/44* (2013.01); *D06C 23/04* (2013.01); *D06H 7/00* (2013.01); *B26F 1/42* (2013.01); *B26F 2001/4418* (2013.01); *B26F 2001/4436* (2013.01); *B26F 2001/4472* (2013.01)

(58) Field of Classification Search

CPC .... Y10T 83/04; B26F 1/44; B26F 1/42; B26F 2001/418; B26F 2001/4436; B26F 2001/4472; D06C 23/04; D06H 7/00

See application file for complete search history.

(56) References Cited

U.S. PATENT DOCUMENTS

| | | | | |
|---|---|---|---|---|
| 2006/0196327 | A1* | 9/2006 | Larsen | B26F 1/44 83/13 |
| 2008/0003409 | A1 | 1/2008 | Deng | |
| 2011/0082020 | A1* | 4/2011 | Tsai | B31F 1/07 493/324 |

FOREIGN PATENT DOCUMENTS

| | | | |
|---|---|---|---|
| BE | 502567 | A | 4/1951 |
| EP | 2551010 | A1 | 1/2013 |

OTHER PUBLICATIONS

Extended Search Report for European Patent Application No. 20185094.8-1016 dated Nov. 16, 2020.

UK Search Report for UK Patent Application No. GB1910269.8 dated Jan. 4, 2021.

* cited by examiner

*Primary Examiner* — Phong H Nguyen

(74) *Attorney, Agent, or Firm* — Mandelbaum Silfin Economou LLP; John S. Economou

(57) ABSTRACT

The invention relates to a die for cutting a shape or pattern from a material, the die being composed of a base plate (1) comprising an upper surface (2) and a lower surface (3). The die comprises one or more raised edges (4) in the form of a pattern or shape to be die-cut or embossed, on each of the upper and lower surfaces, such that the die can be used to die-cut or emboss two sheets of material simultaneously.

3 Claims, 2 Drawing Sheets

CRAFTING DIES

The present invention relates to a die, such as a die for use in crafting, and in particular, to a double-sided die which can allow two pieces of material to be die-cut or embossed simultaneously.

A die is a tool which can be used to cut a pattern or shape from a material when subjected to a force. Typically, dies are used in a die cutting machine, which can be hand operated or motorized, and which applies a force to the shaped or patterned die to cut the corresponding shape or pattern from a sheet material against which the die has been placed. Dies can also be used to emboss onto a sheet material, by causing a pattern or shape to be raised or embossed in the material, rather than cut. Dies are extremely versatile and are commonly used in the craft industry, for paper craft and fabric crafting, in areas including decoupage, card making and scrap booking. Commonly used materials include sheets of paper, cardstock, plastic, thin metal, leather, metal foil, fabric, etc.

Known dies are generally formed by chemical etching, engraving, injection moulding, die-casting or stamping a planar metal plate to create thin raised edges, in the form of a pattern or shape to be cut or embossed on a material, on one side of the metal plate. In use, the die is placed against the material to be die-cut or embossed, with the raised edges facing the material, and pressed against the material (usually in a die cutting machine) to cut or emboss the pattern or shape on the material. In this way, the shape or pattern is cut or embossed on the material sheet. However, only a single material sheet can be cut or embossed at a time. This can be time-consuming, and inefficient, particularly if a large number of die-cut or embossed items are required. In addition, a die can be used for only a single pattern or shape, meaning that a large quantity of dies are needed if a variety of shapes or patterns are required—this has disadvantages in terms of both storage, and cost.

It would be advantageous to provide a die which could obviate or mitigate one or more of these problems.

SUMMARY OF THE INVENTION

According to the present invention there is provided a die for cutting a shape or pattern from a material, the die being composed of a base plate comprising an upper surface and a lower surface, wherein the die comprises one or more raised edges in the form of a pattern or shape to be die-cut and/or embossed, on each of the upper and lower surfaces.

Advantageously, the die, comprising one or more raised edges on each of the upper and lower surfaces, allows a pattern or shape to be die-cut and/or embossed on two pieces of material at the same time. Alternatively, the die can be used to die-cut and/or emboss both the front and back of a folded sheet of material simultaneously—such as a folded sheet of cardstock used to form a greeting card, or a folded piece of fabric. This is particularly beneficial when a die cutting machine is used, as it allows two sheets of material, or both the front and back of a folded sheet of material, to be die-cut within a single pass through the press.

Preferably, the raised edge on at least one of the upper and lower surfaces is a raised cutting edge.

Advantageously this ensures at least one side of the die can be used as a cutting die.

Optionally, at least some of the raised edges on each of the upper and lower surfaces are raised cutting edges.

Advantageously this ensures both sides of the die can be used as a cutting die. This is generally the preferred embodiment.

The base plate may be substantially planar.

The dimensions of the die can vary, and in general can be tailored to the application of interest. For instance, in an embodiment for use as a craft die, the base plate may have a thickness (T) of from 0.1 mm to 2 mm, from 0.1 to 1 mm, from 0.1 to 0.8 mm, from 0.1 mm to 0.5 mm, or from 0.2 mm to 0.4 mm. Typically, after etching both sides, the base plate has a thickness of 0.1 mm to 0.3 mm.

The base plate is provided with raised edges, defining a pattern or shape, on each of its upper and lower surfaces.

The raised edge may be a cutting edge or an embossing protrusion or a combination of both. In some embodiments it is envisaged that the raised edges on one surface are raised cutting edges and can therefore be used to cut a pattern in a sheet of material, whilst the raised edges on the other side are embossing protrusions (i.e. and this side does not have any cutting edges). This allows the same die to be used for both cutting and/or embossing as desired.

In the context of the invention, a raised cutting edge is a thin raised edge or projection that serves to cut through the material when a force is applied to the die. Accordingly, the edge does not need to be a blade or razor edge, once it is sufficiently thin such that the application of pressure thereto when placed against a sheet of material, causes the edge to cut through the material. Thus, the dimensions of the die and the raised edges can be adjusted based on the intended use of the die, i.e. in terms of the material and the type of press to be used.

For instance, each raised cutting edge may have a width (W) of 0.08 to 0.4 mm, from 0.08 to 0.3 mm or from 0.08 to 0.2 mm. In an exemplary embodiment the width is 0.13 mm. The width (W) is measured at the tip of the raised edge, i.e. where it first comes into contact with the material to be die-cut. However, as would readily be appreciated, the width does not need to be consistent, and the raised edge could be tapered from the base plate to the tip.

Each thin cutting edge is raised from the surface of the plate such that it can cut through the material when passed through a press (or otherwise pressed against the material to be die-cut). The height (H) of the raised cutting edge from the surface of the plate can therefore be adjusted based on, for instance, the intended use of the die, taking into account factors such as the thickness of the material it will be used for, the type of press etc. However, in an embodiment, the height (H) of each raised cutting edge from the plate surface is from 0.2 mm to 3 mm, from 0.2 mm to 2 mm, from 0.2 mm to 1 mm, or from 0.7 to 0.9 mm. An exemplary height (H) is 0.4 to 0.5 mm. A skilled person would appreciate that the height of the raised edges on each of the upper and lower surfaces can differ, to allow the same die to be used for different applications, such as for papercraft and fabric appliqué which would require a relatively shorter and longer height, respectively, Optionally, the pattern or shape on each of the upper and lower surfaces is different. In this way, a single die can be used to form two different shapes or patterns. This has advantages in terms of storage of dies, for instance, and also in terms of cost, as a single die can be manufactured and sold for two separate patterns or shapes.

Alternatively, the pattern or shape on each of the upper and lower surfaces is the same. This can be beneficial when increased throughput of die-cutting is required, as it allows the same pattern or shape to be cut onto two pieces of material at the same time.

In some embodiments one of the upper or lower surfaces is provided with a raised cutting edge (with or without additional embossing protrusions) and the other surface is provided with embossing protrusions but no cutting edge. In this way a single die can be used for either or both of cutting and embossing.

It is generally preferred that at least one of the surfaces are used for cutting.

The pattern or shape defined by the one or more raised edges on each of the upper and lower surfaces is not particularly limited. For instance, patterns or shapes that may be defined on each side of the die include numbers, letters, symbols, animals, flowers, floral patterns, lace patterns etc.

In an embodiment, the base plate has one or more apertures.

One or more apertures can be included in the base plate. This aperture can be used to, for instance, disengage a single sheet of material from the die if it has not released fully therefrom after being passed through the press.

In an embodiment, the base plate comprises one or more embossing protrusions. These embossing protrusions can be provided on the upper surface, on the lower surface, or on each of the upper and lower surfaces, as required. The protrusions can be used to emboss a pattern or shape on the material surface.

In an embodiment, each protrusion has a width (W) of from 0.2 mm to 100 mm, from 0.2 mm to 20 mm, from 0.2 to 10 mm, from 0.2 to 2 mm or from 0.2 to 0.5 mm. However, a skilled person would readily appreciate that in practice, a protrusion could extend over the entire surface, or the majority of the surface of the base plate and so this is not particularly limited.

In an embodiment, each protrusion has a height (H) of from 0.1 to 3 mm, from 0.1 to 2 mm, from 0.1 to 1 mm or from 0.1 to 0.5 mm. The height (H) is measured from the surface of the base plate.

In an embodiment, each protrusion has a rounded shape.

The protrusions can optionally be provided on one or both surfaces of the die. The protrusions are generally broader in width than the raised edges. The protrusions are generally shorter in height than the raised edges. In practice, the protrusions can be used to emboss a pattern on the surface of the material. As the protrusions are less sharp, and shorter than the die-cutting raised edges, the protrusions do not pierce the material, but press against and raise the material when passed through the press, so as to leave an imprinted or embossed pattern or shape on the material surface.

The die can be formed of any suitable material. In an embodiment, the die is formed of a metal. In an embodiment, the die is formed of an alloy, such as steel. The die may be formed by known processes, including, but not limited to, chemical etching.

The die may be a thin metal die.

According to the invention there is provided a kit for cutting a shape or pattern, the kit comprising the die according to the invention in its first aspect, and a cutting sheet.

It is common when using a die cutting machine to position a traditional one-sided die on a magnetic plate, and then place the sheet material on top, to form a sandwich configuration which can subsequently be passed through the die cutting machine. When the two-sided die according to the present invention is used, the magnetic sheet can be replaced with a cutting sheet. In an aspect of the invention the two-sided die is provided with two cutting sheets, which can be placed on the opposing side of each sheet of material. i.e. to form the following configuration: cutting sheet, material sheet, die, material sheet, cutting sheet. In an embodiment, the cutting sheet is a carbon fibre sheet. Carbon fibre is particularly useful as the cutting sheet, as it is durable and doesn't warp over time, and it positions the sandwiched die firmly so as to improve the cut. However, in theory any suitable material could be used to form the cutting sheet.

According to an aspect of the invention there is provided a method for cutting or embossing a shape or pattern, comprising the steps of:

providing a die composed of a base plate comprising an upper surface and a lower surface, wherein the die comprises one or more raised edges in the form of a pattern or shape to be die-cut or embossed, on each of the upper and lower surfaces;

arranging a first sheet of material perpendicular to the one or more raised edges of the upper surface and a second sheet of material perpendicular to the one or more raised edges of the lower surface such that the die is sandwiched between the first and second sheets of material; and applying a force to the sandwiched die such that the one or more raised edges cut through or raise the first and second sheets of material to form the pattern or shape.

The force can be applied by passing the sandwiched die through a press, such as a roller press.

Preferably at least one of the one or more raised edges in the form of a pattern or shape to be die-cut, on either of the upper and lower surfaces is a raised cutting edge.

More preferably at least one of the one or more raised edges in the form of a pattern or shape to be die-cut, on each of the upper and lower surfaces is a raised cutting edge.

Clearly the first and second sheets can be arranged adjacent to either the upper or lower surfaces, in any order. In addition, the die could be used to die-cut or emboss on a single sheet of material, if required. i.e. as a conventional die. Further plates or shims can be added to the sandwich, to manipulate the level of pressure applied to the die and to achieve the desired cut. Typically, the plates and shims are arranged, from bottom to top, as clear plate, plate for die, paper or sheet of material, die, paper or sheet of material, plate for die, clear plate. Typical thicknesses of the plates are:

| Plate/Shim | Thickness (mm) | Variance |
|---|---|---|
| Clear Plates | 3.5 | ±0.03 |
| Metal Shim | 0.25 | −0.02 |
| PP Plastic Shim | 1.7 | +0.03-0.02 |
| Rubber Shim | 0.8 | +0.1-0.02 |
| Magnetic Shim | 0.7 | ±0.05 |
| Plates for Double-Sided Dies | 1.0 | ±0.05 |

The die can also be used to cut a shape or pattern from a single sheet of material. In this embodiment, the die may be provided with a shield, such as a deformable sheet, which can be positioned against the surface of the base plate comprising the unwanted pattern or shape, thereby allowing the die to be used to die-cut a single sheet.

Various further features and aspects of the invention are defined in the claims.

BRIEF DESCRIPTION OF THE DRAWINGS

Embodiments of the present invention will now be described by way of example only with reference to the accompanying drawings where like parts are provided with corresponding reference numerals and in which.

DETAILED DESCRIPTION

Figure 1:
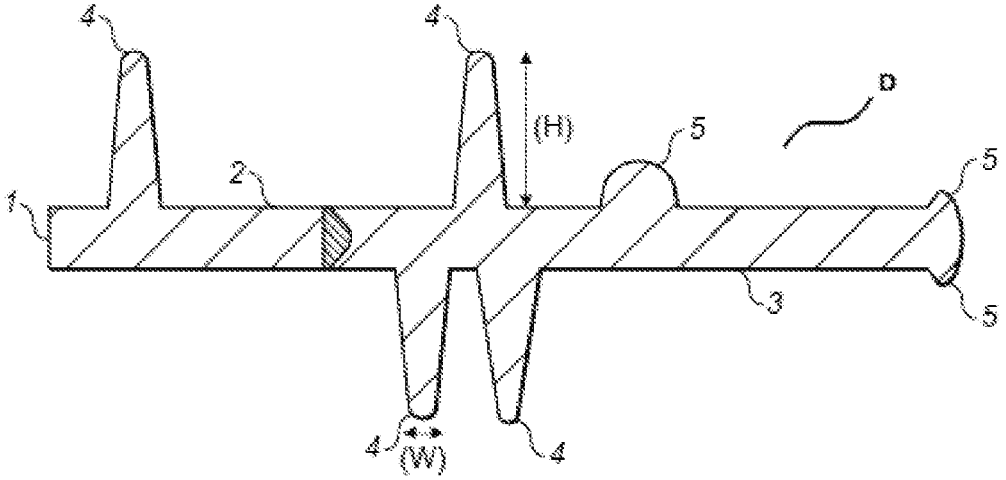
FIG. 1 is a side-view of a double-sided die according to the present invention.

FIG. 1 provides a simplified schematic diagram of a die according to the present invention. The die comprises a base plate (1), which in the embodiment shown is a substantially planar thin metal plate. The base plate (1) comprises an upper surface (2) and a lower surface (3). Thin raised cutting edges (4) define a shape on each of the upper (2) and lower surfaces (3). In the embodiment shown, the raised edges have a width (W) of approximately 0.13 mm and a height (H) from the base plate of approximately 0.4-0.5 mm. In the embodiment shown, the plate also comprises a number of embossing protrusions (5). In this embodiment, the die comprises embossing protrusions (5) on both the upper and lower surfaces, however a skilled person will recognise that the protrusions are optional if embossing is not required, and so may not be provided on the die, or may be provided on one surface only. The embossing protrusions (5) are wider and shorter than the die-cutting raised cutting edges (4) and, in the embodiment shown have a width of approximately 0.45 mm and a height from the base plate of approximately 0.25 mm. The embossing protrusions (5) are gently rounded in shape. When pressure is applied to the die which has been placed against a material surface, the raised cutting edges (4) will pierce and cut through the material, while the embossing protrusions (5) can be used to emboss a pattern or shape on the material surface, without cutting or piercing the surface.

Typically, the dies are produced by etching the required shapes of patterns onto the upper and lower surfaces and creating the raised edges. After etching, the remaining base plate material is no more than 0.1 mm-0.3 mm wide (not including the raised edges). The outer surfaces/edges of the base plate can themselves become sharp and as such typically include a bevelled edge.

Figure 2:
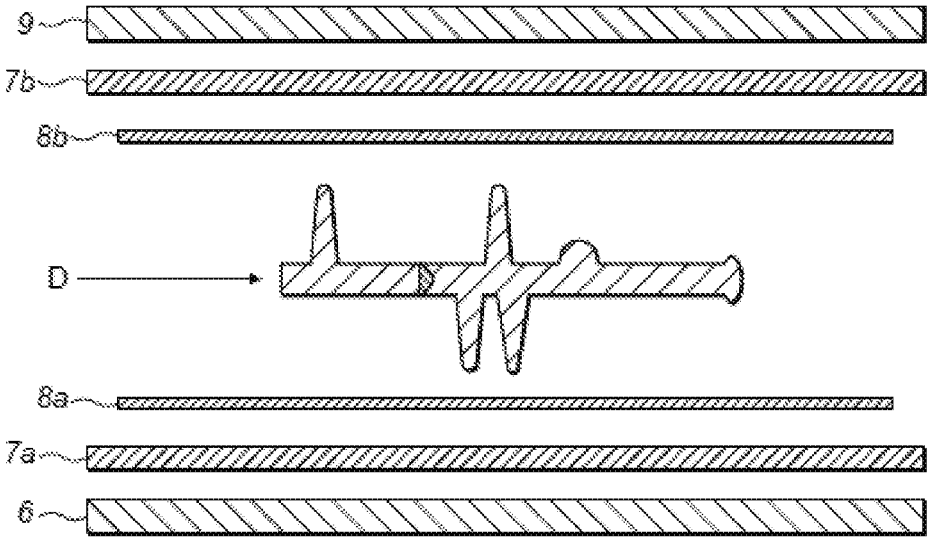
FIG. 2 is a schematic showing a die-cutting sandwich including the die according to the present invention.

An exemplary method of using the die according to the present invention will now be described with reference to FIG. 2. A base cutting plate (6) is placed on a flat surface. A first carbon fibre plate (7*a*) is placed on top of the base cutting plate (6) and a first sheet of material (8*a*), in this case a sheet of cardstock, is placed on top of the carbon fibre plate (7*a*). The die (D) according to the invention is then placed on the sheet of material, positioned such that the surface comprising the pattern desired to be cut out on the first sheet of material (8*a*) is facing downwards. In this example, the upper surface (2) of the die defines a heart symbol, whereas the lower surface (3) of the die defines a flower pattern. A second sheet of material (8*b*), again a sheet of cardstock onto which the second shape or pattern is to be cut, is then placed on top of the die. A second carbon fibre sheet (7*b*) is placed on top of the second sheet, and a clear cutting plate (9) is placed on top. This completes the sandwich to be fed into a roller press (not shown), and the thickness of the sandwich ensures that the dies and paper are kept in position as they pass through the press. However, if required, a user can use a low tack adhesive tape to fix the die (or dies) into position on the cardstock. The roller press applies high pressure to the sandwiched die, and causes the shape or pattern raised on each side the die to be cut into the first sheet (8*a*) and second sheet of material (8*b*), respectively.

In this illustrative example, the die also comprises one or more embossing protrusions (5). These protrusions are wider and more rounded in shape than the raised edges of the die cutting pattern, and in use, they serve to raise (emboss) a pattern on the material surface. To emboss using the die according to the present invention, a rubber mat may be included in the roller press 'sandwich', as is commonly used in the crafting community, to control the thickness of the sandwich and to ensure that the embossing protrusions raise or depress the material, giving a smooth finish.

Figure 3:
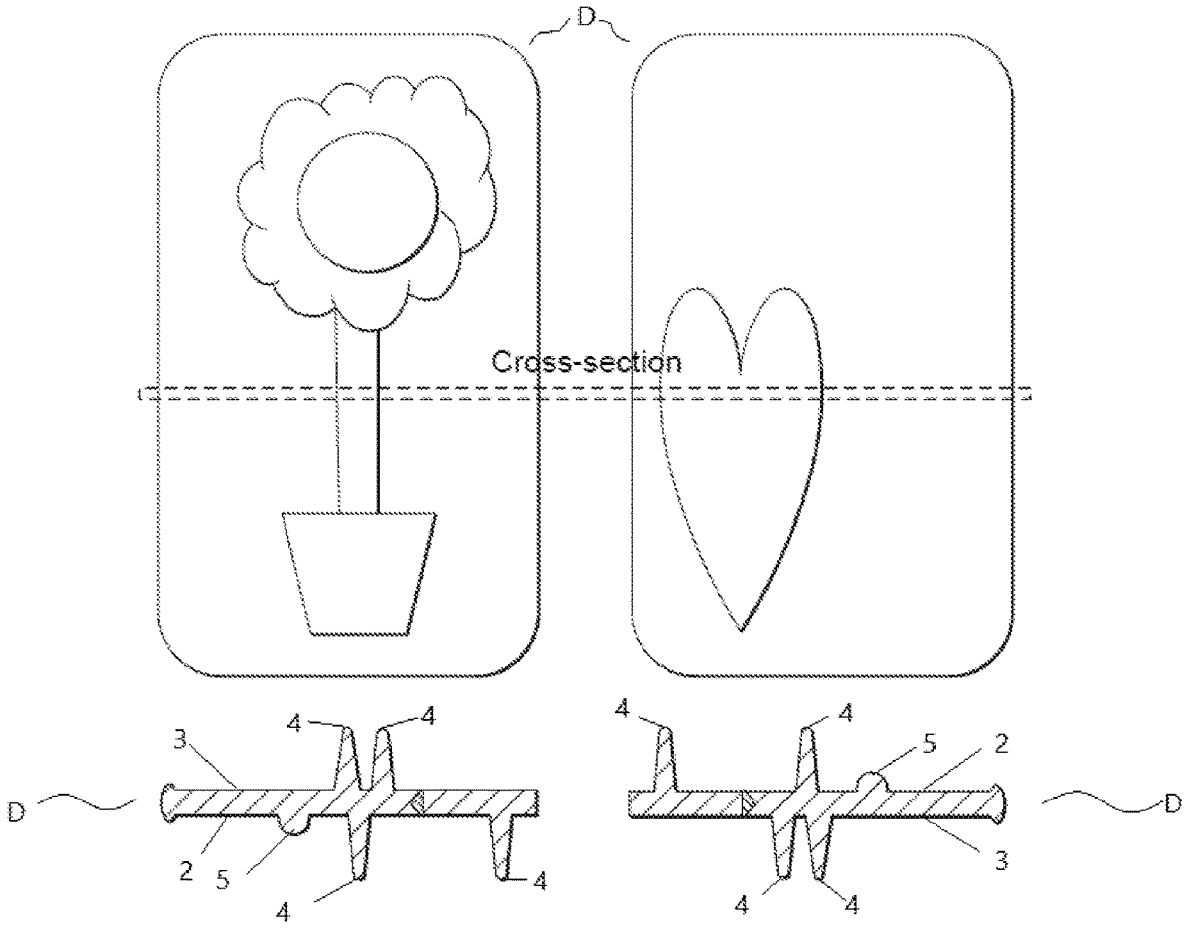
FIG. 3 shows a cross-sectional view of a die according to the invention wherein the raised edges of the upper surface define a heart symbol and the raised edges of the lower surface define a flower.

FIG. 3 shows a cross-sectional view of a die (D) according to the invention wherein the raised cutting edges (4) of the upper surface (2) define a heart symbol and the raised cutting edges (4) of the lower surface (3) define a flower pattern. Cross-sections are shown with respect to the upper surface (2) and lower surface (3) of the die (D). The raised cutting edges (4) form a line with features such as the outer circumference of a heart or stem of a flower while embossing protrusions (5) allow for decorative elements of pattern to substantially simultaneously be embossed. Embossing patterns are not shown.

As would be understood by one skilled in the art, the die cutting sandwich that is placed in the roller press can be adjusted to take account of a variety of factors, including the material being used, the thickness of the material, the pressure being applied by the press and type of press (e.g. electric, hand operated etc.), the desired effect to be achieved on the material and so on. Adjustments can be made by adding or removing layers in the sandwich, such as by including a shim, using an embossing plate etc., all within the remit of a skilled crafter. In this way, the desired effect of the die-cutting and/or embossing on the material can be achieved.

While the die has been described above in the context of what is known as a thin metal die, one skilled in the art would appreciate that the invention is not so limited, and the die can be formed of alternative materials, or be adapted in terms of its dimensions, depending on the intended use.

All of the features disclosed in this specification (including any accompanying claims, abstract and drawings), and/or all of the steps of any method or process so disclosed, may be combined in any combination, except combinations where at least some of such features and/or steps are mutually exclusive. Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features. The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations. In addition, even if a specific number of an introduced claim recitation is explicitly recited, those skilled in the art will recognize that such recitation should be interpreted to mean at least the recited number (e.g., the bare recitation of "two recitations," without other modifiers, means at least two recitations, or two or more recitations).

It will be appreciated that various embodiments of the present disclosure have been described herein for purposes of illustration, and that various modifications may be made without departing from the scope of the present disclosure. Accordingly, the various embodiments disclosed herein are not intended to be limiting, with the scope being defined by the following claims.

I claim:

1. A method for cutting and/or embossing a shape or pattern, comprising the steps of:

providing a die composed of a base plate comprising an upper surface and a lower surface, wherein the die comprises one or more raised edges in the form of a pattern or shape to be die-cut, on each of the upper and lower surfaces;

arranging a first sheet of material perpendicular to the one or more raised edges of the upper surface and a second sheet of material perpendicular to the one or more raised edges of the lower surface such that the die is sandwiched between the first and second sheets of material; and applying a force to the sandwiched die such that the one or more raised edges cut through or raise the first and second sheets of material to form the pattern or shape.

2. The method of claim 1, wherein at least one of the one or more raised edges in the form of a pattern or shape to be die-cut, on either of the upper and lower surfaces is a raised cutting edge.

3. The method of claim 1, wherein at least one of the one or more raised edges in the form of a pattern or shape to be die-cut, on each of the upper and lower surfaces is a raised cutting edge.

* * * * *